United States Patent [19]

Hickman

[11] Patent Number: 4,858,902

[45] Date of Patent: Aug. 22, 1989

[54] WORKBENCH VISES

[75] Inventor: Ronald P. Hickman, Trinity, United Kingdom

[73] Assignee: Tekron Licensing BV, De Leersum, Netherlands

[21] Appl. No.: 389,289

[22] Filed: Jun. 19, 1982

[30] Foreign Application Priority Data

Jun. 18, 1981 [GB] United Kingdom ..... 8118749

[51] Int. Cl.[4] ..... B25B 1/02

[52] U.S. Cl. ..... 269/88; 269/139; 269/212; 269/221

[58] Field of Search ..... 269/139, 134–136, 269/212–214, 219–220, 258, 266, 247, 283, 279, 88, 208, 54, 207, 223, 221

[56] References Cited

U.S. PATENT DOCUMENTS

| | | | |
|---|---|---|---|
| 90,783 | 6/1869 | Riggs | 269/139 |
| 91,625 | 6/1869 | Henderson | 269/139 |
| 416,244 | 12/1889 | Weller | 269/221 |
| 745,001 | 11/1903 | Coffield . | |
| 749,732 | 1/1904 | Hanson et al. . | |
| 830,896 | 9/1906 | Harrah | 269/207 |
| 899,779 | 9/1908 | Yost . | |
| 1,310,351 | 7/1919 | Koontz . | |
| 1,328,492 | 1/1920 | Carman | 269/223 |
| 1,475,058 | 11/1923 | Elzy | 269/221 |
| 1,811,518 | 6/1931 | Palmer . | |
| 1,825,460 | 9/1931 | Kappner . | |
| 1,951,869 | 3/1934 | Janiszewski | 269/136 |
| 2,655,191 | 10/1953 | Partin | 269/54 |
| 2,969,817 | 1/1961 | Zabich | 269/208 |
| 3,063,707 | 11/1962 | Kelley | 269/221 |
| 3,615,087 | 10/1971 | Hickman . | |
| 4,159,821 | 7/1979 | Hickman . | |
| 4,449,704 | 5/1984 | Goulter | 269/88 |

FOREIGN PATENT DOCUMENTS

| | | | |
|---|---|---|---|
| 2458160 | 6/1976 | Fed. Rep. of Germany | 269/208 |
| 6357 | of 1887 | United Kingdom | 269/213 |
| 638944 | 6/1950 | United Kingdom . | |
| 645743 | 11/1950 | United Kingdom . | |
| 649397 | 1/1951 | United Kingdom . | |
| 1289541 | 9/1972 | United Kingdom . | |
| 2063111 | 6/1981 | United Kingdom | 269/258 |
| 381425 | 10/1982 | United Kingdom . | |

*Primary Examiner*—Robert C. Watson

*Attorney, Agent, or Firm*—Brumbaugh, Graves, Donohue & Raymond

[57] ABSTRACT

A bench vise includes a stationary structure carrying one clamping jaw. A square section tube is arranged to cantilever outwardly from the stationary structure and the tube carries a second clamping jaw. Coarse adjustment can be obtained by tilting the tube about a horizontal axis and then moving it with respect to the stationary structure. Fine adjustment is obtained and clamping forces are exerted by operation of a screw-operated mechanism carried by the tube and acting on the clamping jaw carried by the tube.

The tube can be withdrawn from the stationary structure and rotated through 90° in either direction to obtain an alternative orientation of the clamping jaw carried by the tube.

15 Claims, 8 Drawing Sheets

WORKBENCH VISES

BACKGROUND

1. Field of the Invention

The present invention relates to workbench vises. It is particularly but not exclusively applicable to bench vises of the metal working variety.

2. The Prior Art

Many forms of workbench vises are known; some are bolted to the top of a workbench and are generally used for metal-working. One well known construction has a stationary jaw of rectangular shape, for example ½"–¾" deep and 3"–4" wide. This jaw is formed as part of a casting which has flanges for bolting to the workbench top. The casting has a rectangular opening through which an inverted U-shaped slide passes, the slide also comprising a casting which affords an upstanding movable jaw to cooperate with the stationary jaw, the slide being shifted by a tommy-bar handle at its front end. This handle rotates a screw threaded rod passing through a threaded boss located on the casting of the stationary jaw.

This type of construction is excellent for many clamping functions but it has a significant limitation in that the area of the clamping faces of the jaws is limited and the horizontally elongate rectangular shape means that it is not ideal for clamping a workpiece which extends vertically. This disadvantage can be overcome to some extent by forming the jaws with vertically extensive side portions, but there is still a problem if it is intended that the same vise should have the capability of clamping workpieces either having parallel sides or of irregular shape.

SUMMARY

According to one aspect of the present invention a workpiece vise includes a pair of clamping jaws capable of relative movement for clamping purposes by means of an adjustment mechanism, the relative movement comprising either a movement in a linear direction in which the clamping jaws are maintained parallel, or a movement by which the gap between the jaws at one end is greater than at the other end, one jaw and the adjustment mechanism being capable of location in at least two different fixed orientations with respect to the second jaw, movement between the orientations including rotation of the one jaw and the adjustment mechanism about an axis parallel to said linear direction. The jaws may be mounted with respect to each other to permit coarse adjustment by bodily movement of one jaw towards and away from the other. Thus the one jaw and the adjustment mechanism may be mounted for coarse adjustment by bodily movement towards and away from the second jaw. Specifically according to one embodiment the said one jaw and the adjustment mechanism are mounted on a first part, and the second jaw is mounted on a second part, the first and second parts being capable of location in at least two different fixed orientations with respect to the second jaw, movement between the orientations including rotation of the one jaw and the adjustment mechanism about an axis parallel to said linear direction. Further according to said embodiment, the first and second parts have cooperating thrust members to transmit loads between them on clamping of a workpiece between the jaws.

In order to permit the coarse adjustment referred to above the thrust members may be separated by at least a tilting of said parts, for example the tilting including an upward tilting of the one jaw and the adjustment mechanism about a horizontal axis.

The one jaw and its adjustment mechanism may be mounted on a square section bar or tube arranged to cantilever outwardly from a stationary structure, adapted to be secured to the workbench, and to which the second jaw is secured. In such a construction the bar or tube may be removable from the stationary structure and thereafter rotatable about its length in order to achieve said rotation of the one jaw and the adjustment mechanism, whereafter the bar or tube is reinserted into the stationary structure.

The one jaw may have a generally rectangular abutment face which cooperate with different portions of an abutment face on said second jaw in said different fixed orientations. In this case the second jaw may be of generally inverted U shape, and the one jaw cooperates with different limbs of the U in its different fixed orientations.

The one jaw and the adjustment mechanism may be capable of location at three different fixed orientations with respect to the second jaw by rotation through 90° intervals.

In one embodiment the adjustment mechanism comprises a pair of spaced screws connected to the movable jaw and to supporting structure by angleable connections.

In an alternative construction the adjustment mechanism comprises a first adjustment screw arranged to move the one jaw in said linear direction, and a second adjustment screw arranged to move the one jaw so that the gap between the jaws at one end is greater than at the other end, the second adjustment screw being moved with the one jaw when the first adjustment screw is operated.

According to another aspect of the present invention a workbench vise comprises a stationary structure having means for securing it to a workbench, the stationary structure affording a first clamping jaw and a guideway positioned below the first clamping jaw for receiving an elongate, coarsely translatable, member which is part of a movable structure, theguideway and elongate member having cooperating locating parts which, in an operative position, retain the elongate member against translation with respect to the stationary structure, and, in an inoperative position permit such translation, movement of the cooperating parts from the operative position to the inoperative position being caused by a tilting of the elongate member about a horizontal axis, whereafter the elongate member can be withdrawn from a first orientation with respect to the guideway of the stationary structure, and, after turning of the elongate member about an axis extending lengthwise of the member, be reinserted into the guideway of the stationary structure in a second orientation, the elongate member carrying a second clamping jaw, at least one of the clamping jaws being mounted on its respective structure by means of an adjustment mechanism operation of which shifts its associated jaw with resepct to the other jaw for the clamping of a workpiece between the jaws.

According to yet another aspect of the present invention a workbench vise comprises a stationary structure having means for securing it to a workbench, the stationary structure affording a first clamping jaw and a guideway positioned below the first clamping jaw for receiving an elongate, coarsely translatable, member of generally square cross section and which is part of a movable structure, the guideway and elongate member having cooperating locating parts which, in an operative position, retain the elongate member against translation with respect to the stationary structure, and, in an inoperative position, permit such translation, said locating parts including, in the case of the elongate member, a row of apertures in each of at least two elongate side faces thereof, and, in the case of the stationary structure, at least one abutment receivable in one of said apertures, release of said abutment from said one aperture being caused by a tilting of the elongate member about a horizontal axis, whereafter the elongate member can be withdrawn from a first orientation with respect to the stationary structure in which any of said apertures in one face thereof can be engaged by said abutment, the elongate member, after turning about an axis extending lengthwise of the member when in its withdrawn condition, being capable of being reinserted into the stationary structure in a second orientation in which another of its said elongate side faces has its apertures arranged to cooperate with said abutment, the elongate member carrying a second clamping jaw, at least one of the clamping jaws being mounted on its respective structure by means of an adjustment mechanism operation of which shifts its associated jaw with respect to the other jaw for the clamping of a workpiece between the two jaws.

BRIEF DESCRIPTION OF THE DRAWINGS

The invention may be carried into practice in various ways but two specific embodiments will now be described by way of example with reference to the accompanying drawings, in which.

DETAILED DESCRIPTION

Figure 1:
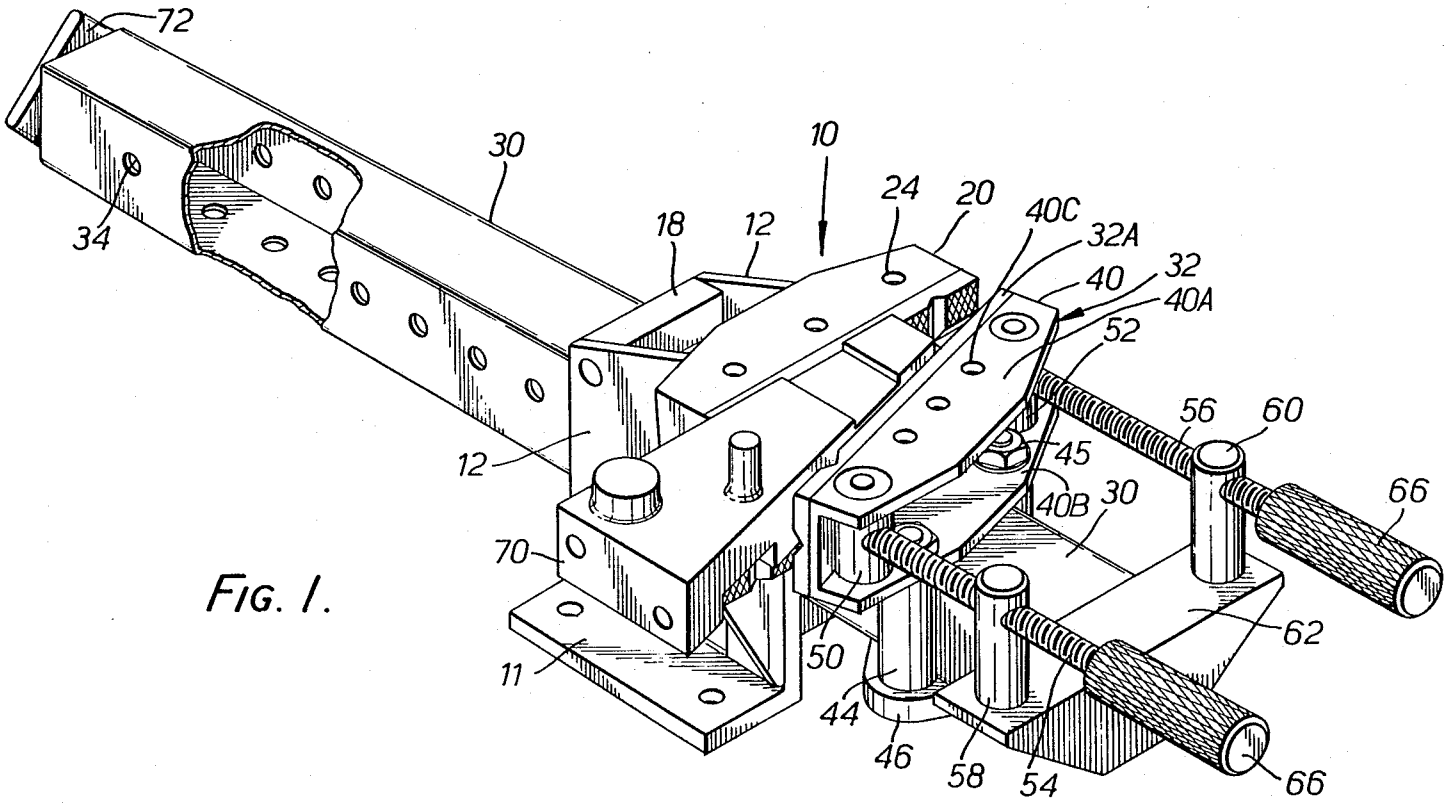
FIG. 1 is a perspective view of a bench vise according to the present invention in one operative mode.

FIGS. 1 to 5 show a bench vise which includes a fixed structure generally indicated at 10 and which can be secured to a bench by means of bolts or screws passing through flanges 11 of the fixed structure 10. The flanges 11 extend outwardly from vertical sides 12 of the stationary structure. The sides 12 are spaced apart by a pair of lower transverse members 14 and 16 respectively (see FIG. 4) and an upper transverse member 18, the transverse members 14 and 18 being rotatable, while the transverse member 16 is stationary.

Figure 2:
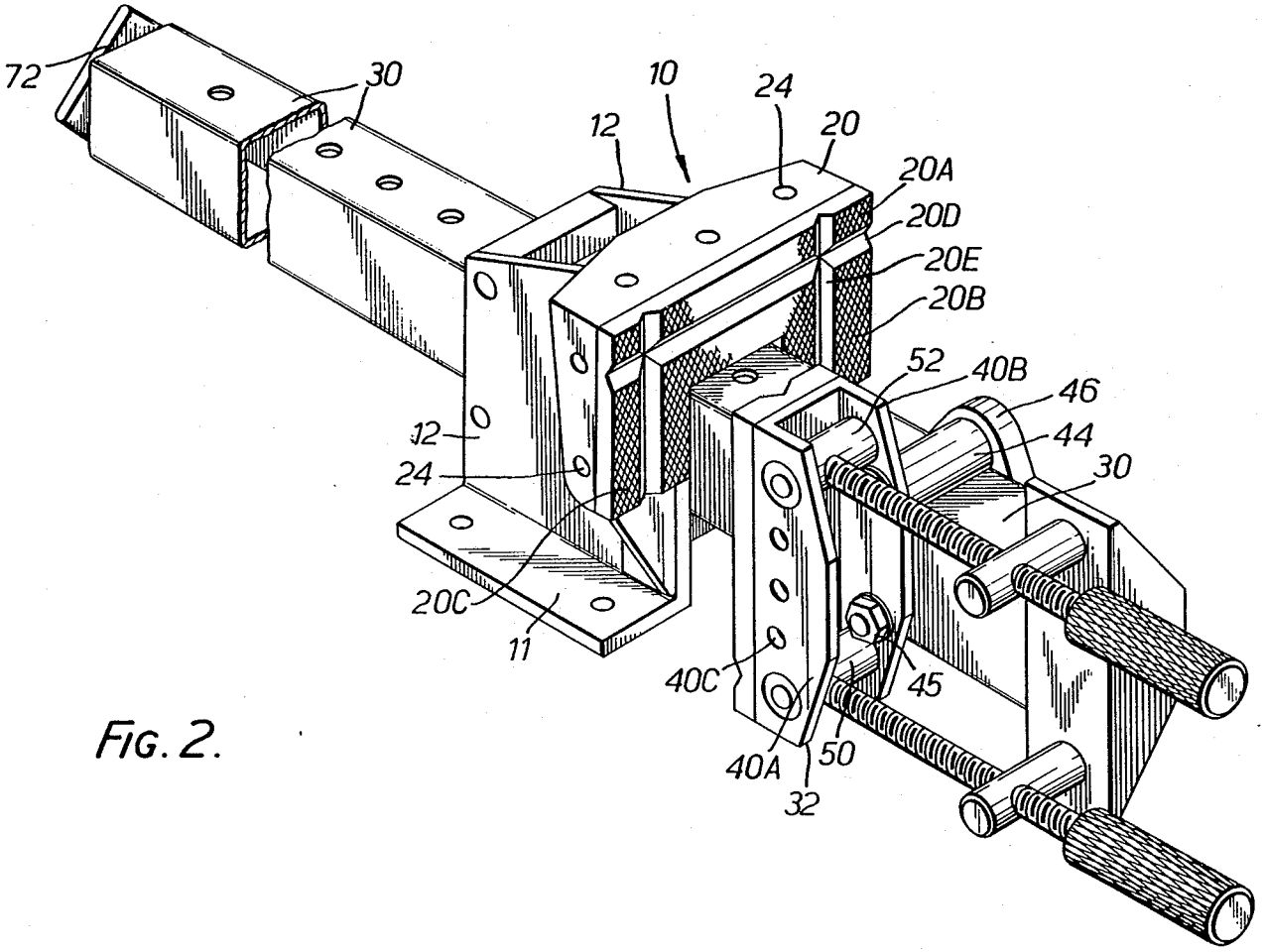
FIG. 2 is a perspective view similar to FIG. 1 with the vise in a second operative mode.

Forming part of the stationary structure 10 is a first clamping cheek 20 which, as shown in FIG. 2, is of generally inverted U shape or form. Thus it comprises a generally horizontal limb 20A and a pair of downwardly extending vertical limbs 20B and 20C. These limbs are provided with V grooves 20D, in the case of the horizontal limb 20A, and 20E in the case of the vertical limbs 20B and 20C. The V grooves are of conventional form and, for example, are of particular application for use in clamping pipes.

The top and side faces of the stationary clamping cheek 20 are provided with a number of cylindrical holes 24, namely three holes in the top face and two holes in each of the side faces, to receive clamping abutments which are capable of swivelling around the axes of the holes and which can be used for clamping workpieces externally of the clamping cheek.

Figure 4:
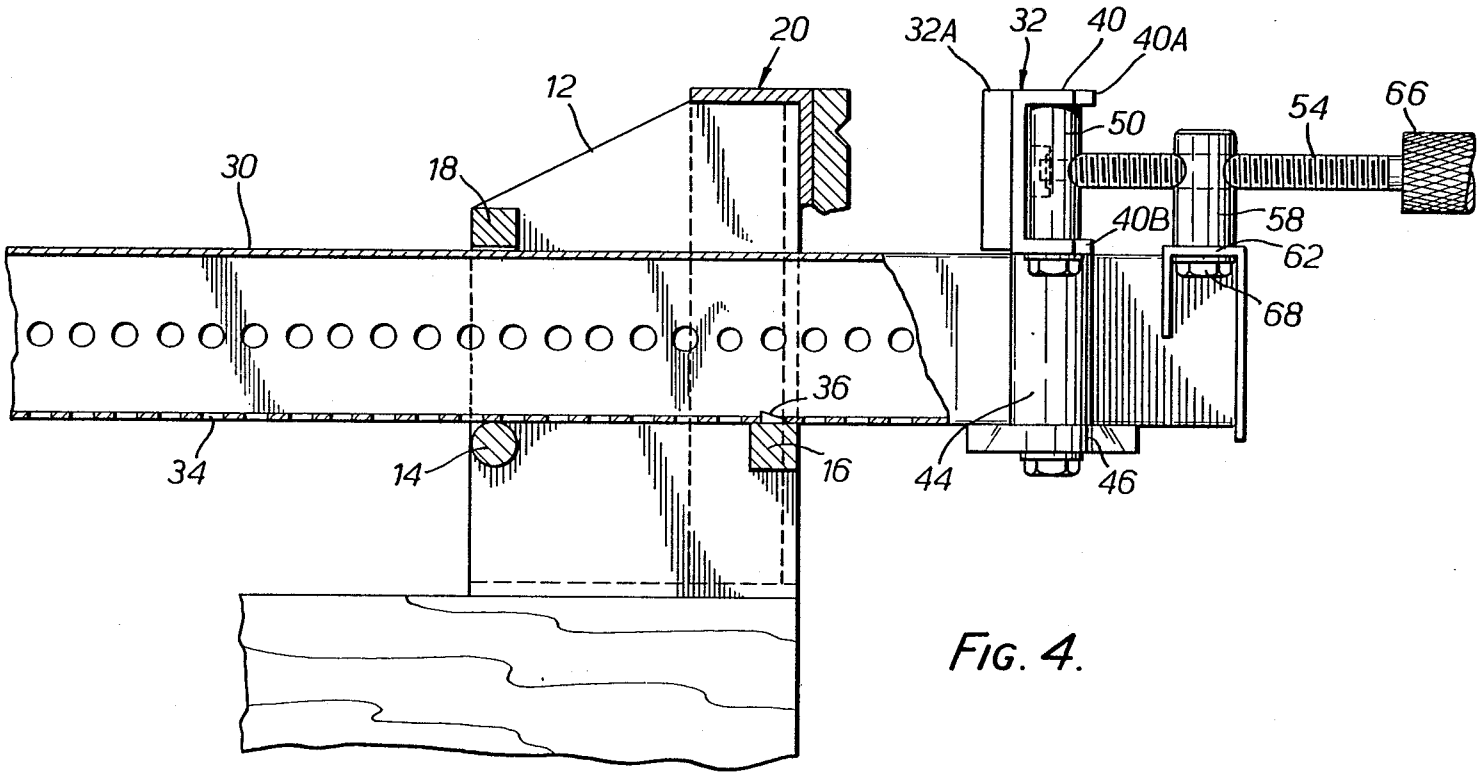
FIG. 4 is a part-sectional side elevation of the bench vise in the mode of FIG. 1.
Figure 5:
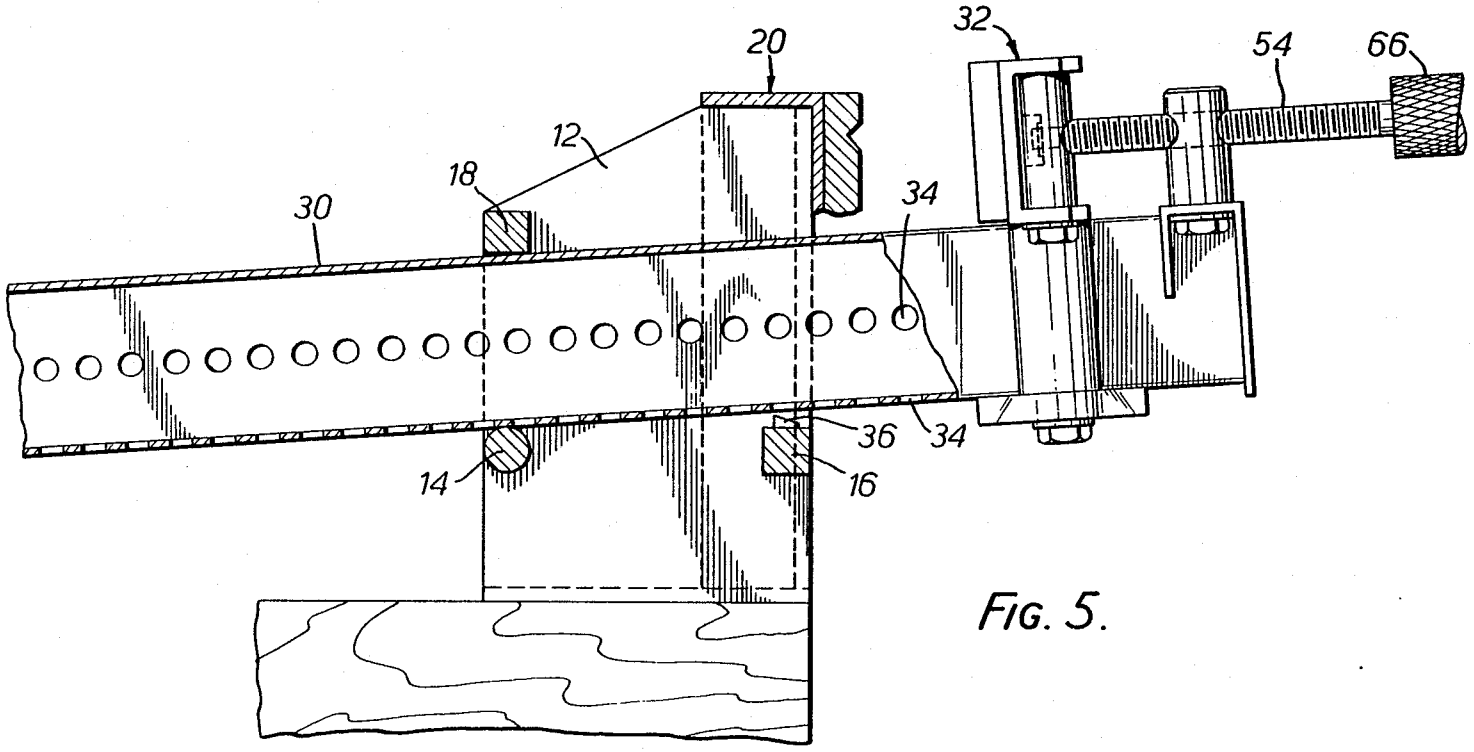
FIG. 5 is a view similar to FIG. 4 showing part of the bench vise displaced.

Extending closely between the side members 12 above the transverse members 14 and 16 is an elongate tube 30 of square cross-section and on the front end of which is mounted a movable clamping cheek 32. In the orientation of the tube 30 shown in FIG. 1 the two side faces and the lower face of the tube are provided with equally spaced circular apertures 34 into one of which a projection 36 on the transverse member 16 extends to locate the tube as shown in FIG. 4 in a fixed relation with respect to the stationary structure 12. By lifting the tube at the right-hand end, in FIG. 5, it can be tilted and disengaged from the projection 36 and then shifted bodily to the left or right to provide for coarse adjustment between the fixed clamping cheek 20 and the movable clamping cheek 32.

Also by complete removal of the tube 30 from the fixed structure 12, the tube can be turned through 90° from its operative mode of FIGS. 1 and 4, for example, to achieve the second operative mode of FIG. 2 in which it will be seen that the top face of the tube (which is not provided with the apertures 34) faces to the left in the drawing to position the movable clamping cheek in its second operative mode opposite the limb 20C of the fixed clamping cheek 20.

The movable clamping cheek 32 comprises a clamping member 32A which is secured to a vertical face of a generally U-sectioned, U-shaped jaw 40 having an upper flange 40A and a lower flange 40B. The upper flange 40A is provided with threecircular holes 40C corresponding to the holes 24 in the fixed clamping cheek and again arranged to receive plug-in abutments.

The jaw 40 is located on the tube 30 in such a manner that it is capable of moving horizontally either in a linear manner parallel to the direction of the length of the tube 30 or by rotation about one or more vertical axes (i.e., perpendicular to the tube 3) in a manner to be described but is restrained against tilting or rotation about horizontal axes as seen in FIGS. 1 and 4. For this purpose the lower flange 40B has extending downwardly therefrom on each side of the tube 30 a post 44 secured to the flange 40B by a nut 45. The lower ends of the posts 44 are interconnected by a plate 46 fitting against the underside of the tube 30 in the operative mode of FIGS. 1 and 4. When the jaw 40 extends transversely of the tube 30 the bushes 44, which preferably are made of nylon or other low friction material are slightly spaced from the vertical faces of the tube to permit angling of the jaw 40 for example to the position of FIG. 1, the angling and end (side to side) float of the jaw 40 being limited by engagement of the posts 44 with the side faces of the tube 30.

Extending between the upper and lower flanges 40A and 40B of the jaw 40 at the ends thereof are cylindrical rods 50 and 52 which are mounted between the said flanges for movement about vertical axes in FIG. 1 extending through the axis of each rod 50 and 52. Secured to the rods 50 and 52 are horizontal screw threaded rods 54 and 56, respectively, the screw threads of which cooperate with screw threaded bores in a pair of studs 58 and 60, respectively. These studs are upstanding from a horizontal flange 62 which is welded to the forward end of the tube 30. Each screw threaded rod 54 and 56 has a knurled handle 66. The studs 58 and 60 are secured to the horizontal flange 62 by means of bolts extending down through the flange and carrying nuts 68 one of which is shown in FIG. 4. The arrangement is such that the studs 58 and 60 can rotate about the axis of the bolts carrying the nuts 68.

By virtue of this mechanism, therefore the, jaw 40 carrying the cheek 32 can be moved by rotation of one or both of the handles 66. If both handles are rotated at the same speed the jaw will maintain a parallel relationship to the cheek 20, but, if one screw is rotated alone or at a different speed to that of the other screw, an angular disposition of the jaw 40 can be obtained, for example, in FIG. 1 for the clamping of a tapered workpiece 70. It will be appreciated that the extent of the relatively fine adjustment which can be achieved by means of the screws 54 and 56 is limited due to the limited length of the screws. If a greater degree of adjustment or spacing of the jaws is required this can be readily achieved by shifting the movable jaw 40 bodily with the tube 30 to increase or decrease the coarse spacing between the clamping cheeks. This is achieved by tilting the tube upwards to the FIG. 5 position to release the abutment 36 from one of the apertures 34. Thus when coarse adjustment is required, after releasing the tube from the abutment 36, it can be moved bodily forwards or backwards to achieve the coarse adjustment. Normally to prevent forward withdrawal of the tube from the stationary structure a square catch 72 (see FIG. 1) is provided which is spring mounted to the position shown in FIG. 1 but which can be rotated about a horizontal axis to bring the square catch into line with the square section of the tube 30. This permits withdrawal of the tube completely from the fixed structure after which it can be rotated, for example through 90°, and reinserted into the stationary structure to achieve the position of FIG. 2 and FIG. 3. This is of particular application when it is desired to secure a workpiece 76 in the manner shown in FIG. 3. This workpiece has a tapered form but due to protuberances such as 78 and 80 it cannot be clamped in any way other than that shown in FIG. 3 when, for example carrying out a tapping operation using a tap 82.

Figure 3:
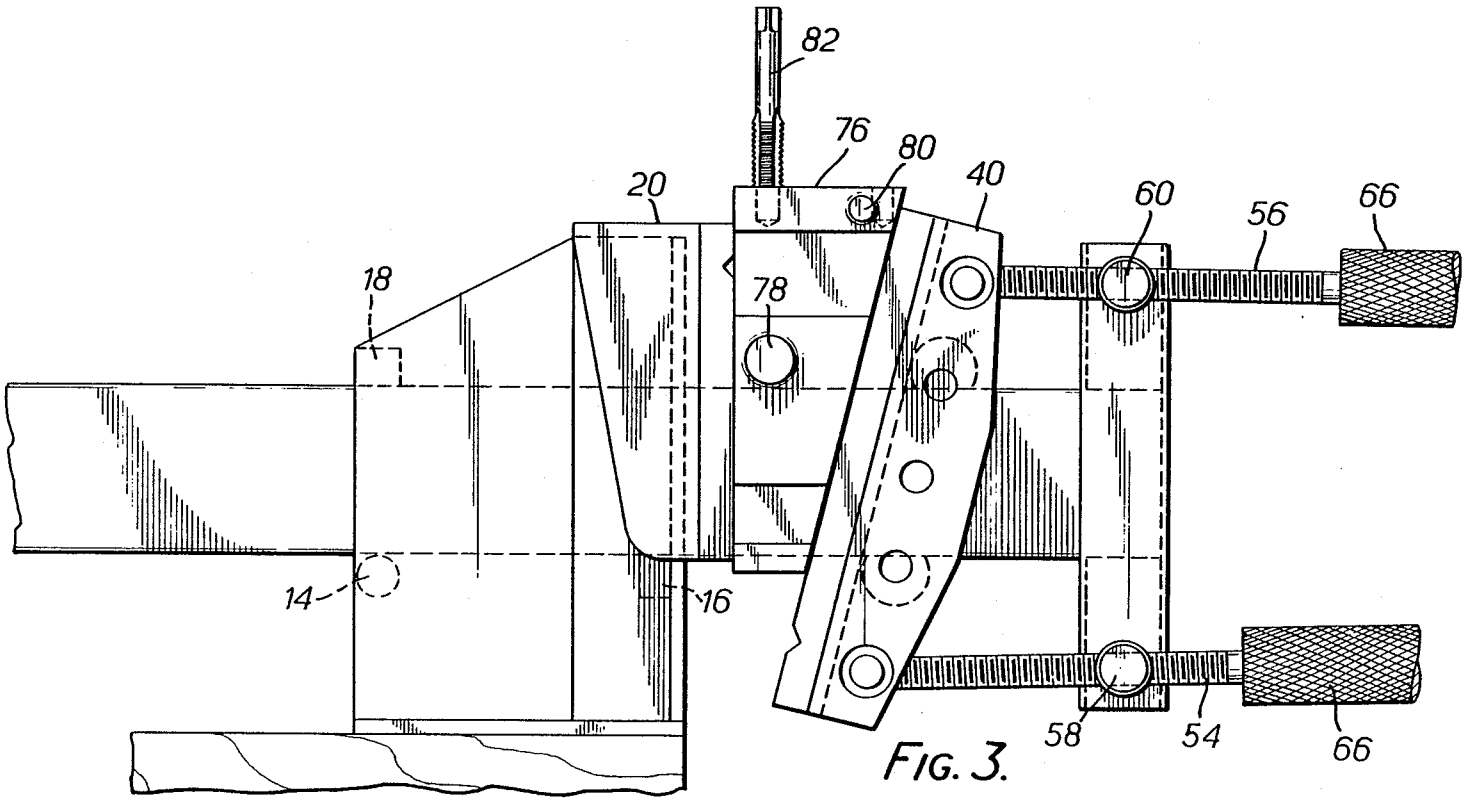
FIG. 3 is a side elevation of the bench vise in its operative mode of FIG. 2.

By this facility of being able to turn the tube 30 through 90°, the angling of the movable jaw 40 can either occur about a vertical axis in FIGS. 1 and 4 or about a horizontal axis in FIGS. 2 and 3, i.e., about an axis generally perpendicular to the surface of tube 30 on which the movable jaw 40 slides.

FIGS. 6 to 9 show an alternative embodiment which is similar in some respects to the first embodiment and which accordingly, in those cases where the parts are similar, bear similar reference numerals. Thus the structure of FIGS. 6 to 9 includes a stationary structure generally similar to that of the first embodiment and incorporating an inverted U-shaped fixed cheek 20 which cooperates with a movable cheek 80 which differs from that of the first embodiment. There is again a tube 30 which is movable with respect to the fixed structure 10 and which can be located either in the operative mode of FIG. 6 in which the movable cheek 80 extends horizontally or in the second operative mode of FIGS. 8 and 9 in which the movable cheek extends vertically. The movable cheek 80 is secured to a generally U-shaped jaw 100, the side limbs of which extend within a head 102 to which the jaw 100 is pivotally mounted by means of a pivot pin 104. A lateral adjusting knob 106 is provided to one side of the head 102 which is interconnected with the jaw 100 positively to pivot the jaw 100 about the pivot pin 104 to angle the cheek 80 with respect to the cheek 20. Thus in the work mode of FIG. 6 the angling takes place about a vertical axis extending through the pivot pin 104. Fine adjustment of the cheek 80 and the jaw 100 together with the head 102 is achieved by rotation of a second knob 108 which causes a square shaped bar 110 on which the head 102 is mounted to move into and out of the end of the tube 30. It will be appreciated that precisely the same type of clamping can be achieved with the embodiment of FIGS. 6 to 9 as can be achieved with the first embodiment, although not in the same sequence of operations of the clamping/adjusting screws as with the twin-screw structure of that embodiment. Thus the moving cheek 80 can be moved either in a parallel manner with respect to the fixed cheek, by operation of the knob 108, or in an angular manner for fine adjustment, by operation of the lateral adjusting knob 106. Furthermore coarse adjustment can be achieved by shifting the tube 30 with respect to the stationary structure 10. In this embodiment this is achieved by withdrawal of a spring loaded plunger 111 shown in section in FIG. 7, the end 112 of which engages in one of a number of apertures 114 provided in three sides of the square section tube 30.

Figures 6, 7:
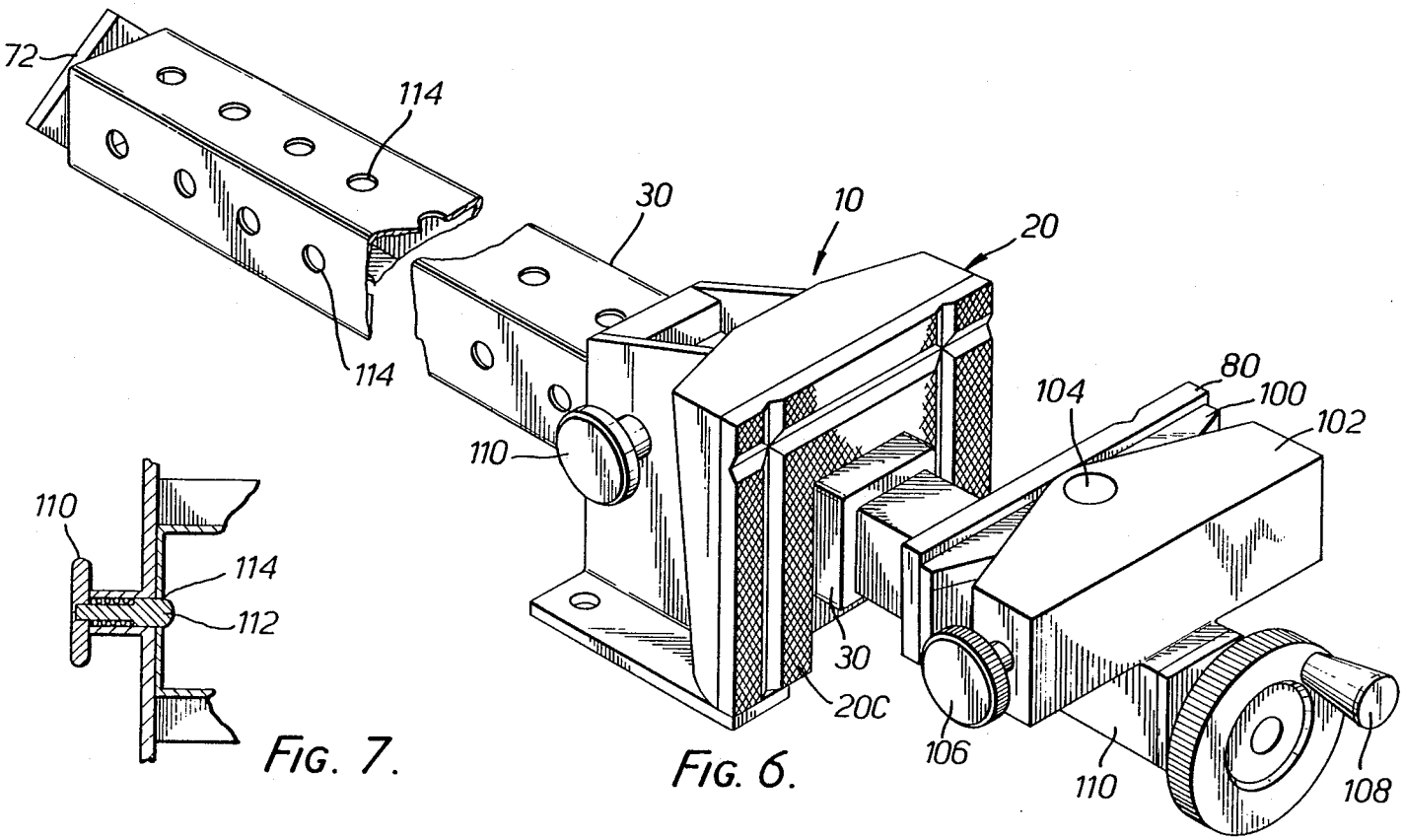
FIG. 6 is a perspective view of a second embodiment of bench vise in one operative mode.
FIG. 7 is a detail sectional elevation of an adjustment mechanism of the vise of FIG. 6.
Figure 8:
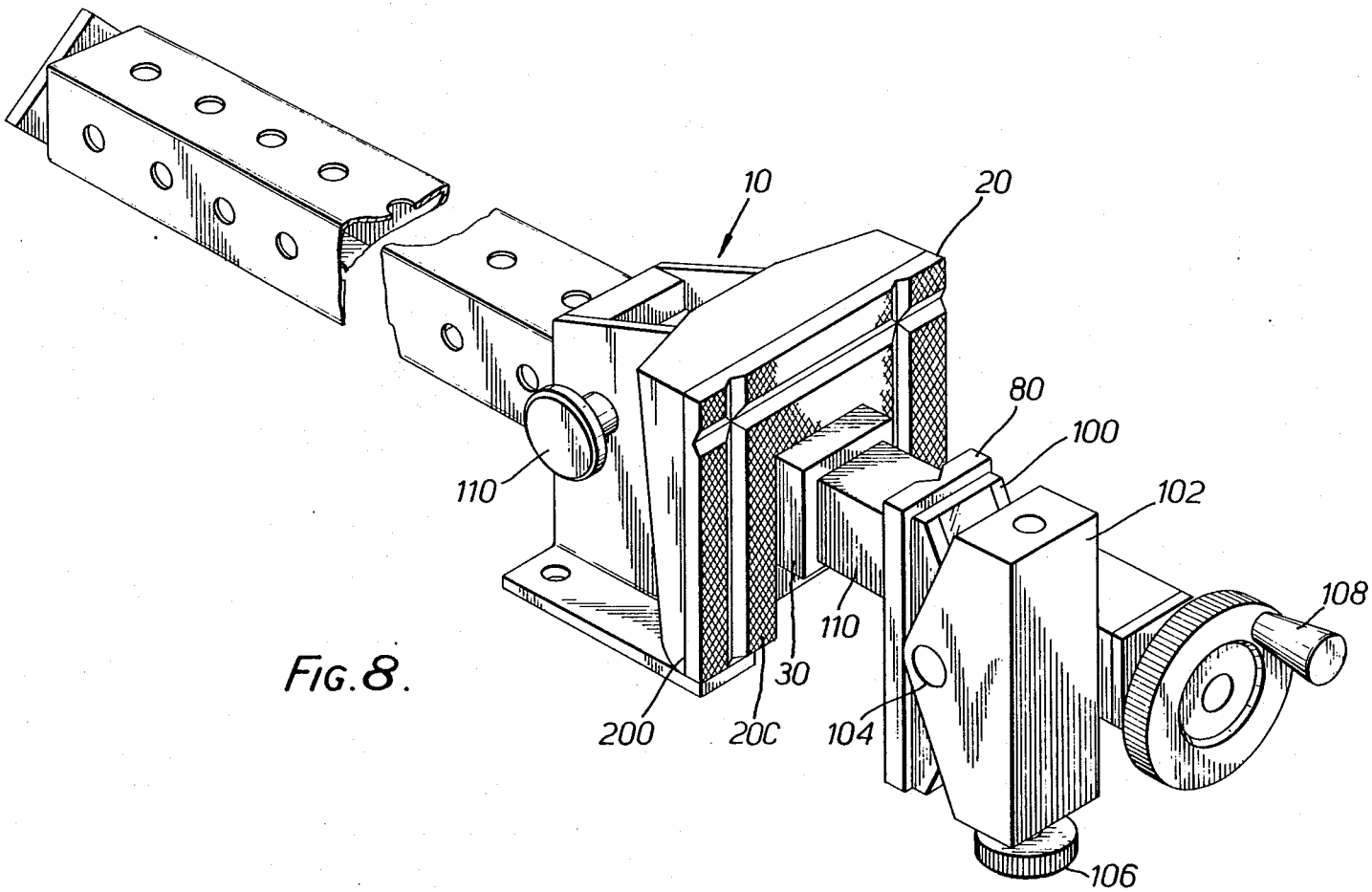
FIG. 8 is a perspective view similar to FIG. 6 showing the bench vise of the second embodiment in a second operative mode.
Figure 9:
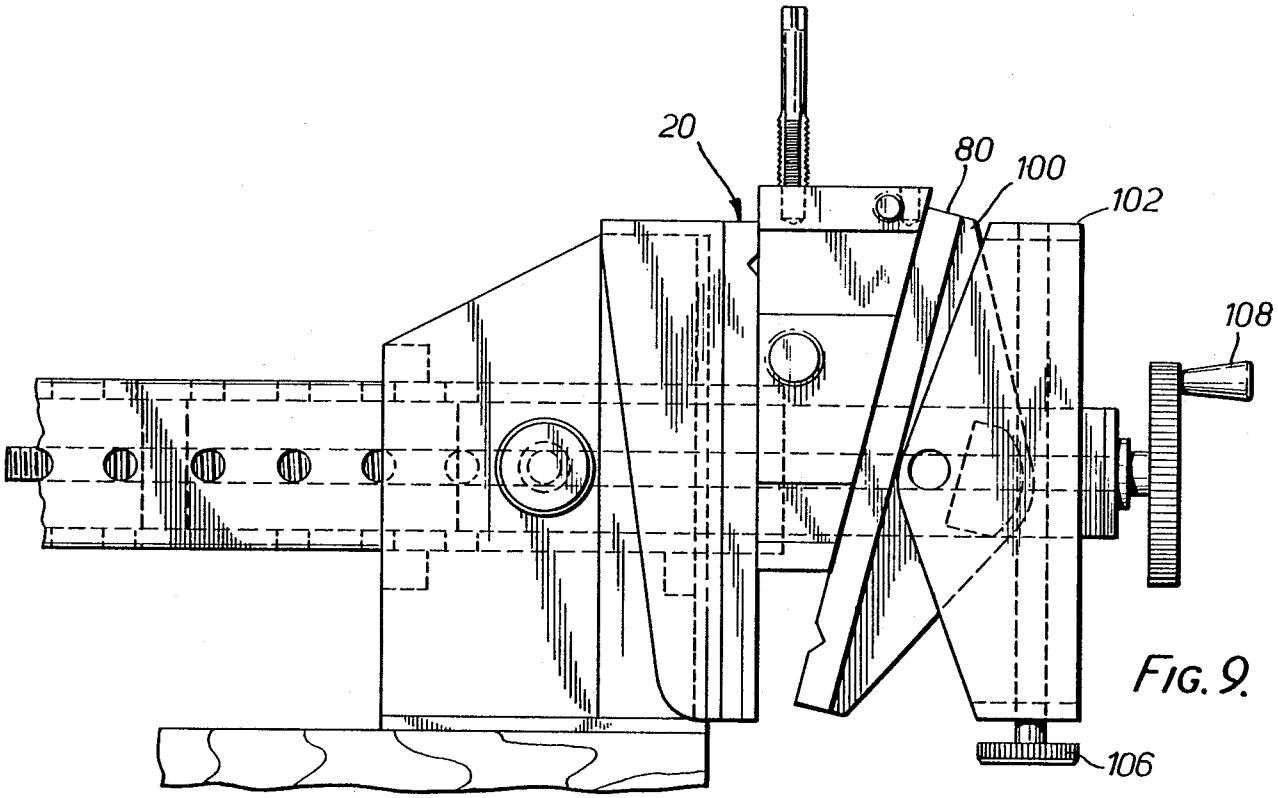
FIG. 9 is a side elevation of the bench vise of FIGS. 6 to 8 in the second operative mode of FIG. 8.

When it is desired to convert the vise from the operative mode of FIG. 6 to the operative mode of FIGS. 8 and 9, the plunger 111 is held withdrawn, and the latch 72 is turned to align it with the tube 30 to permit complete withdrawal of the tube 30 from the fixed structure 10. The tube, with the head 102, is then turned through 90° and re-inserted into the fixed structure 10. Coarse and fine adjustment of the clamping cheek 80 is then achieved by use of the two knobs 106 and 108 in the orientation shown in FIGS. 8 and 9 to enable clamping to be achieved between the cheek 80 and the vertical limb 20C of the cheek 20. It will be noted that in the second embodiment the limb 20C is longer than the corresponding limb in the embodiment of FIGS. 1 to 5 since workpieces can be clamped between lower portions of the cheeks without the loads tending to disengage the tube 110 from the fixed structure 10, as would occur in the first embodiment if the clamping cheek 20C extended below the transverse member 16.

What is claimed as new and desired to be secured by Letters Patent of the United States is:

1. A workbench vise, comprising:

a stationary structure;

means for attaching the stationary structure to a workbench;

a rear clamping jaw carried by the stationary structure;

an elongate member;

means defining a guide way in the stationary structure for slidably receiving said elongate member;

means for supporting a front clamping jaw on said elongate member adjacent the front end thereof and for permitting movement of said front clamping jaw relative to said elongate member;

screw operating means acting between said front clamping jaw and said elongate member for providing clamping movement of said front clamping jaw with respect to said rear clamping jaw;

cooperative locating means carried by said elongate member and said guide way defining means for releasably securing said elongate member in any one of a series of coarsely variable operative positions relative to said stationary structure in each of at least two different rotational orientations of said elongate member and said front clamping jaw relative to said guide way; and means providing for the complete withdrawal of said elongate member, and the front clamping jaw and screw operating means carried thereby, from said guide way and for the reinsertion thereof into said guide way in a different one of said at least two rotational orientations of said elongate member and said front clamping jaw relative to said guide way.

2. A workbench vise as claimed in claim 1 in which said front clamping jaw has a generally rectangular abutment face which cooperates with different portions of a clamping face on said rear clamping jaw in said different orientations of said elongate member and said front clamping jaw relative to said guide way.

3. A workbench vise as claimed in claim 1 in which said rear clamping jaw includes a horizontally elongate clamping surface and at least one vertically elongate clamping surface, and said front clamping jaw cooperates with different ones of said clamping surfaces in said different orientations of said elongate member and said front clamping jaw relative to said guide way.

4. A workbench vise as claimed in claim 1 in which said different orientations of said elongate member and said front clamping jaw relative to said guide way are separated by rotation of said elongate member through 90° intervals.

5. A workbench vise as claimed in claim 1 in which said front and rear clamping jaws each has one or more apertures therein to receive abutments for clamping against a workpiece.

6. A workbench vise as claimed in claim 1 in which said elongate member has a generally symmetrical cross section and said guide way has a generally matching cross section in at least the horizontal transverse direction, whereby a close sliding fit is established between said elongate member and said guide way in at least the horizontal direction in all of said different orientations of said elongate member relative to said guide way.

7. A workbench vise as claimed in claim 6 in which said elongate member has a generally square cross section.

8. A workbench vise as claimed in claim 1, wherein said screw operating means comprises a pair of spaced-apart clamping screws which are positively connected between said front clamping jaw and said elongate member, whereby synchronous operation of the two clamping screws produces translational movement of the front clamping jaw towards and away from the rear clamping jaw, while operation of one clamping screw without the other, or at a different speed than the other, produces angular movement of the front clamping jaw about at least one axis perpendicular to the elongate member.

9. A workbench vise, comprising:

a stationary structure having means for securing it to a workbench;

the stationary structure affording first and second stationary clamping jaw surfaces, and having a guide way positioned below said first stationary clamping jaw surface, said first and second stationary clamping jaw surfaces each being generally elongate and rectangular;

the guide way being adapted to receive an elongate, coarsely translatable member which is part of a movable structure;

the guide way and elongate member having cooperating locating means for releasably securing the elongate member in any selected one of a number of coarsely variable positions with respect to the stationary structure in each of at least two orientations of said elongate member relative to said guide way;

said elongate member being adapted for complete withdrawal from the guide way and, after said complete withdrawal, turning of the elongate member about its lengthwise axis and reinsertion thereof into the guide way in a second, different orientation with respect to the stationary structure than the first orientation of the elongate member prior to said withdrawal;

the elongate member carrying at the end thereof remote from the stationary structure a movable clamping jaw having an operative clamping face which is generally elongate and rectangular;

said operative clamping face of the movable clamping jaw being substantially aligned with said first stationary clamping jaw surface of said stationary structure in said first orientation of said elongate member and with said second stationary clamping jaw surface of said stationary structure in said second orientation of said elongate member; and means for moving said movable clamping jaw along said elongate member towards and away from said stationary clamping jaw surfaces to clamp a work piece therebetween.

10. A workbench vise as claimed in claim 9 wherein said first stationary clamping jaw surface comprises a horizontally elongate clamping surface and said second stationary clamping surface comprises at least one vertically elongate clamping jaw surface, and wherein said operative clamping face of said movable clamping jaw comprises a horizontally elongate clamping face in said first orientation of said elongate member and a vertically elongate clamping face in said second orientation of said elongate member.

11. A workbench vise as claimed in claim 1 wherein said first and second stationary clamping jaw surfaces comprise a continuous clamping surface having a horizontally extending limb and at least one vertically extending limb.

12. A workbench vise as claimed in claim 10 wherein said first and second stationary clamping jaw surfaces comprise a continuous generally U-shaped clamping surface having a horizontally extending limb and two vertically extending limbs, said generally U-shaped clamping surface surrounding said guide way opening on the top and vertical sides thereof.

13. A workbench vise as claimed in claim 9 wherein said means for moving said movable clamping jaw comprises a pair of spaced-apart clamping screws which are positively connected between said movable clamping jaw and said elongate member, whereby synchronous operation of the two clamping screws produces translational movement of the movable clamping jaw towards and away from the first and second stationary clamping jaw surfaces, while operation of one clamping screw without the other, or at a different speed than the other, produces angular movement of the movable clamping jaw about at least one axis perpendicular to the elongate member.

14. A workbench vise, comprising:

a stationary structure, means for securing it to a workbench, the stationary structure affording a stationary clamping jaw and a guide way opening for receiving, in a first rotational orientation, an elongate, coarsely translatable member of generally square cross section, said guideway opening generally conforming in cross section to said elongate member in at least the horizontal direction;

cooperating locating means carried by the guide way and the elongate member for defining a series of operative positions, in said first orientation, between which the elongate member can be shifted during said coarse translation and which when engaged retains the elongate member against translation due to clamping loads;

the elongate member being completely withdrawable from the guide way and reinsertable into the guide way in a second orientation with respect thereto after the elongate member has been rotated through a 90° angle about the lengthwise axis of the elongate member;

said cooperative locating means defining a further series of operative positions, in said second orientation, between which the elongate member can be shifted as aforesaid; and the elongate member carrying at its end remote from the stationary structure a movable clamping jaw which can be adjusted with respect to the elongate member by means of a clamping mechanism which shifts the movable clamping jaw towards and away from the stationary clamping jaw in either of the orientations of the elongate member.

15. A workbench vise as claimed in claim 14 wherein said clamping mechanism comprises a pair of spaced-apart clamping screws which are positively connected between said movable clamping jaw and said elongate member, whereby synchronous operation of the two clamping screws produces translational movement of the movable clamping jaw towards and away from the stationary clamping jaw, while operation of one clamping screw without the other, or at a different speed than the other, produces angular movement of the movable clamping jaw about at least one axis perpendicular to the elongate member.

* * * * *

UNITED STATES PATENT AND TRADEMARK OFFICE

CERTIFICATE OF CORRECTION

PATENT NO. : 4,858,902

DATED : August 22, 1989

INVENTOR(S) : Ronald P. Hickman

It is certified that error appears in the above-identified patent and that said Letters Patent is hereby corrected as shown below:

First page, Item [22], "Jun. 19, 1982" should read --June 17, 1982--;

Column 4, line 25, after "end," insert --as shown--;

Column 4, line 41, "U-sectioned, U-shaped" should read --U-sectioned or U-shaped--;

Column 4, line 50, "tube 3" should read --tube 30--;

Column 5, line 21, after "obtained," insert --as shown,--;

Column 8, line 49, "claim 1" should read --claim 10--.

Signed and Sealed this

Eleventh Day of December, 1990

*Attest:*

HARRY F. MANBECK, JR.

*Attesting Officer*

*Commissioner of Patents and Trademarks*